US005794729A

United States Patent [19]

Van Meter et al.

[11] Patent Number: 5,794,729

[45] Date of Patent: Aug. 18, 1998

[54] COKER UNIT DRILLING EQUIPMENT

[75] Inventors: Eldon L. Van Meter; Lowell L. Pater, both of Corpus Christi, Tex.

[73] Assignee: Spiralex Corporation, Corpus Christi, Tex.

[21] Appl. No.: 587,214

[22] Filed: Jan. 16, 1996

[51] Int. Cl.[6] ..... E21B 7/18

[52] U.S. Cl. ..... 175/424; 175/318

[58] Field of Search ..... 175/65, 67, 385, 175/424, 317, 318, 220

[56] References Cited

U.S. PATENT DOCUMENTS 3,365,007 1/1968 Skipper .
3,455,515 7/1969 Connolly .
4,923,021 5/1990 Courmier .
5,022,799 6/1991 Torres et al. ..... 175/220 X
5,127,710 7/1992 Babichev .

*Primary Examiner*—William P. Neuder
*Attorney, Agent, or Firm*—G. Turner Moller

[57] ABSTRACT

In a petroleum coke operation, a pilot hole is drilled in the coke by high pressure water emitting from downwardly directed nozzles in a drilling assembly. A full hole is eroded in the coke by diverting the high pressure water to a series of full hole nozzles in response to shutting off, and then resupplying, high pressure water to the drilling assembly. This conveniently converts pilot hole operations to full hole operations, which is the normal mode of cutting coke from a drum. Thus, the modes of operation are switched each time water is resupplied to the drilling assembly.

15 Claims, 2 Drawing Sheets

COKER UNIT DRILLING EQUIPMENT

This invention relates to a method and apparatus for drilling a pilot hole and then enlarging the pilot hole, as may occur in removing petroleum coke from the drums in which it is created.

BACKGROUND OF THE INVENTION

Although this invention has application in areas such as mining where a pilot hole is first drilled in the earth and the pilot hole is then enlarged, it will be described in conjunction with an ideal application, i.e. the removal of petroleum coke from the drums in which the coke is created.

Petroleum coke is almost pure carbon produced from the thermal cracking of molecules of the heaviest fractions of crude oil. Crude oil is first sent to a crude unit where volatile fractions, such as gasoline, kerosene and fuel oil are boiled off and condensed using standard distillation technology. The residue from the bottom of the crude distillation column is then directed to a second distillation column which is operated under a vacuum allowing additional volatile fractions to boil off. The residue from the bottom of the vacuum column is very heavy and is known as 6-oil or asphalt. This asphalt is sent to a unit known as a delayed coker where it is rapidly heated to above 900° F. and then delivered into the bottom of a large open vessel known as a coke drum.

In the coke drum, the heated asphalt thermally decomposes due to the intense heat and new substances are formed. Some of these substances comprise carbon atoms only forming a solid, coal like material known as petroleum coke. This coke accumulates inside the coke drum, eventually filling it. The remaining molecules are new, lighter hydrocarbons which are vapors at the temperature of the coke drum. These vapors flow up and out of the coke drum into a vessel that cools and condenses them into their various fractions. When a drum becomes full of coke, the incoming stream of hot asphalt is diverted to a second drum where the process continues.

The full drum is cooled with water. The water is drained, and the large lids known as heads on the top and bottom of the drum are opened. On top of each drum is a structure very similar to an oil field drilling rig, i.e. a 120' tall derrick having a crown block on top, a travelling block suspended by cables from the crown block, a drilling assembly for removing coke from the drum and a winch to wind up and pay out the cable to raise and lower the travelling block so the drilling assembly moves into and out of the coke drum. Modern coker drilling assemblies first bore a 6' diameter hole downwardly through the coke and out the bottom using one or more high pressure water jets aimed in a generally downward direction. This is called the pilot hole. The pilot hole is then enlarged using high pressure water jets aimed in a generally horizontal direction. The dislodged coke and water flow down through the pilot hole and out the bottom of the drum. The operator works the drilling assembly up and down until all of the coke has been removed from the drum.

To this end, devices for directing the high pressure water streams are affixed to the end of the drill stem. The devices are known as the pilot tool for drilling the pilot hole and the cutting tool for removing the coke after the pilot hole has been drilled. Switching out these tools requires the drill stem to be completely pulled from the drum so workers can physically remove the pilot tool and replace it with the cutting tool. Workmen performing these duties are exposed to hazardous vapors coming out of the top opening so the workers must have access to portable breathing equipment.

Frequently, switching between the two tools occurs several times during a given decoking operation because the coke bed often shifts and slumps thereby plugging off the pilot hole. In these situations, the drill stem is pulled from the top of the drum to detach the cutting tool and to replace it with the pilot tool. The pilot hole is redrilled, the drill stem is pulled again, and the cutting tool is reattached so the cutting operation can continue.

Each change of tools requires about a half hour. This contributes to the delay required to get the drum ready for filling and thus limits the rate at which the drums can be filled.

It is not surprising that efforts have been made to simplify and speed up the task of converting from a pilot drilling operation to a horizontal cutting drilling operation. One such attempt is found in U.S. Pat. No. 4,923,021 where a combination bit is converted by a single workman from a pilot operation to a full hole operation. Although this device is some improvement, the drilling assembly still needs to be pulled from the coke drum. Conventional coke drums are on the order of 100' tall and the derrick has a working height of about 100' so the drill stem can be worked up and down in the derrick without removing or adding joints of pipe.

SUMMARY OF THE INVENTION

The concept of this invention is to convert a petroleum coke vessel drilling assembly from a pilot drilling mode to a full diameter decoking mode automatically in response to a remote command. Preferably, the remote command is in the form of manipulation of fluid flow to the assembly caused by the operator turning the pump on and off. Thus, the changes may be made without withdrawing the pilot drilling assembly from the drum and may be made remotely from a suitable control panel located at a convenient location.

To this end, the drilling apparatus includes a combination bit having a first set of nozzles directed generally downwardly to cut a pilot hole and a second set of nozzles directed generally horizontally to cut a full sized hole. A diverter valve within the assembly acts to direct high pressure water to the first set of nozzles or to the second set of nozzles each time fluid flow to the assembly is cycled. The diverter valve includes an indexing valve element that shifts between a first position directing water to the pilot nozzles and a second position directing water to the full hole nozzles. The diverter valve is preferably indexed in response to fluid pressure, such as pumping water through the drilling assembly, so the diverter valve operates automatically and without requiring electrical connections or wireless techniques that would be necessary for operation in response to a command of those types.

The effect of this invention is most dramatic when considering a refinery in which the coker operation is a restriction on throughput. Various segments of refineries are continually being optimized or capacity is being increased in some fashion. Where the throughput of the crude unit rises and the throughput of the vacuum unit rises, because of a variety of improvements, there may be more 6-oil or asphalt created than can be handled by the coker unit and the coker operation becomes a restriction on capacity. The obvious solution is to increase coker capacity which can only be done by decreasing the cycle time. It normally takes about one half hour per cycle to change from one style nozzle to another if everything goes smoothly. Considering situations where the pilot hole has to be redrilled and other difficulties associated with changing from one type drilling to another, the average increase in throughput by use of this invention is in the range of 40 minutes per cycle. Where the coker cycle is thirteen hours, for example, this is more than a 5% increase in overall capacity. In a medium sized refinery where the coker operation is a capacity restriction, a capacity increase of this magnitude in the coker operation means $5–10 million per year.

It is an object of this invention to provide an improved drilling assembly which is shiftable from a pilot hole drilling operation and then a full hole drilling operation in response to a remote command.

A further object of this invention is to provide an improved coker unit drilling assembly.

Another object of this invention is to provide an improved mechanism for shifting a coke drum drilling assembly from a pilot hole operation to a full hole operation.

A still further object of this invention is to provide a pressure responsive mechanism for automatically shifting operation of a coke drum drilling assembly from a pilot hole operation to a full hole operation and then back to a pilot hole operation.

Other objects and advantages of this description will become more apparent as this description proceeds, reference being made to the accompanying drawings and appended claims.

DETAILED DESCRIPTION

Figure 1:
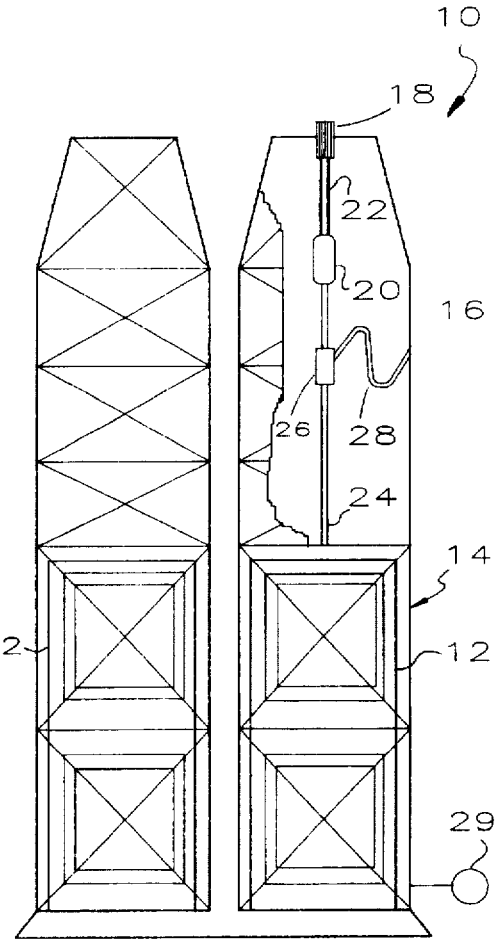
FIG. 1 is a long range, pictorial view of a petroleum coke operation, certain parts being broken away for clarity of illustration.

Referring to FIG. 1, a coker unit 10 comprises a pair of large coke drums 12 , a scaffold 14 around the coke drums 12, and a drilling rig 16 mounted above each of the coke drums 12. Feedstock is admitted to the drums 12 which are then heated to drive off hydrogen atoms attached to carbon atoms in the feedstock molecules. Hydrogen escapes from the drums 12, leaving essentially carbon, known as petroleum coke.

The drilling rigs 16 are analogous to oil field rigs and include a crown block 18, a traveling block 20 suspended from the crown block 18 by a plurality of lines of a cable 22 and a drawworks or winch (not shown) for winding up and paying out the cable 22 and thereby raising or lowering a drill stem 24. Attached to the traveling block 20 is a swivel 26 connected by a flexible hose 28 to a standpipe (not shown) for delivering high pressure water or other cutting fluid from a pump 29 to the drill stem 24. The drill stem 24 is rotated in any suitable manner, as by powering the swivel 26. Those skilled in the art will recognize the coker unit 10, as heretofore described, as being typical of modern petroleum coke operations.

Figure 2:
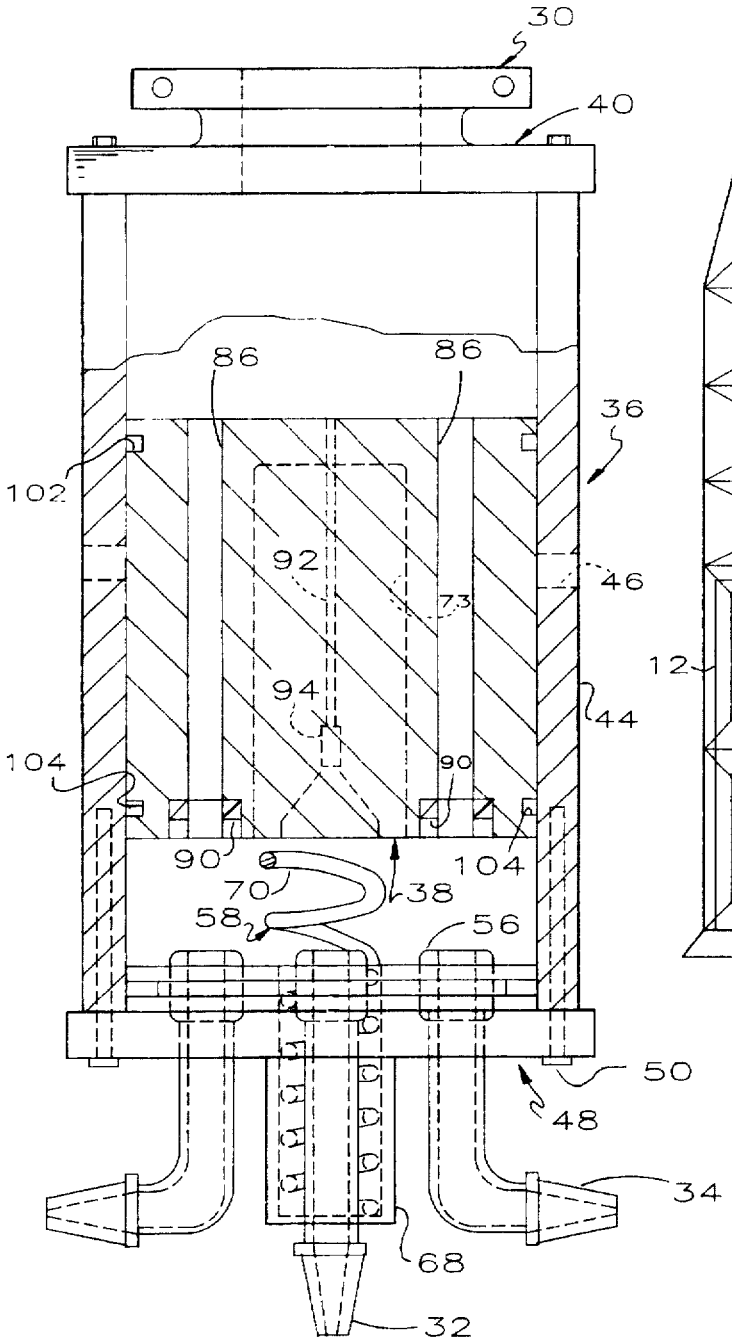
FIG. 2 is an enlarged side elevation view of a coker drum drilling assembly, certain parts being broken away to expose a diverter valve assembly.

Referring to FIG. 2, a drilling assembly 30, on the bottom of the drill stem 24, provides a pilot nozzle array comprising one or more pilot nozzles 32 aimed generally downwardly for excavating a pilot hole through the mass of petroleum coke in the drums 12 and a full hole nozzle array comprising one or more full hole nozzles 34 for cutting the remainder of the coke out of the drums 12.

The drilling assembly 30 comprises, as major components, a housing 36, a diverter valve 38 for selectively directing high pressure water toward the pilot nozzles 32 or toward the full hole nozzles 34 and means for indexing the diverter valve 38 to alternately deliver high pressure water to the pilot nozzles 32 and then to the full hole nozzles 34.

Figure 5:
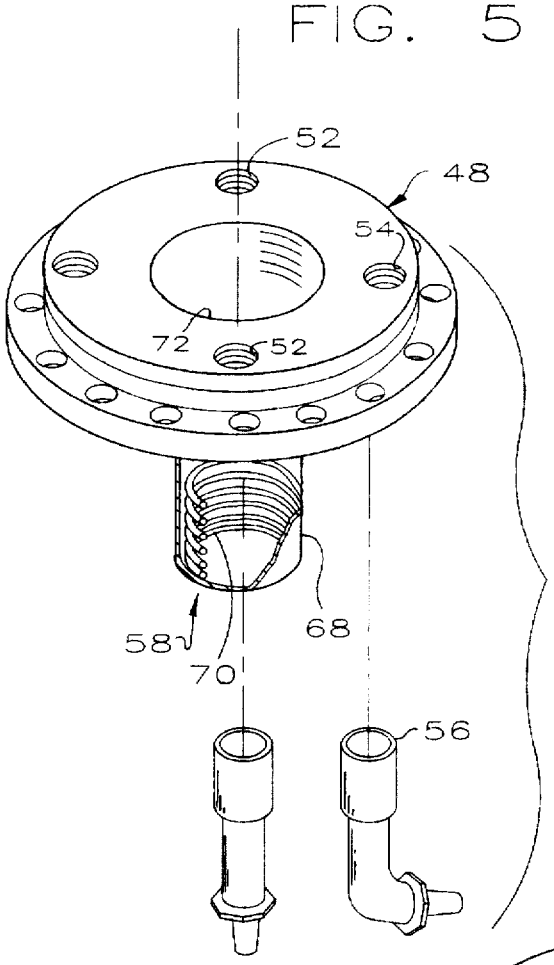
FIG. 5 is an exploded isometric view of the bottom of the diverter valve assembly.

The drilling assembly housing 36 includes a cap 40 having a collar 42 for threadable connection to the drill stem 24, a cylinder 44 having a plurality of openings 46 therethrough and a base plate 48. The cap 40 and base plate 48 are connected to the cylinder 44 in any suitable manner, such as by the provision of threaded fasteners 50. Preferably, two of the pilot nozzles 32 thread into openings 52 in the base plate 48 and two of the full hole nozzles 34 thread into openings 54, as shown in FIGS. 2 and 5. Thus, the pilot nozzles 32 are located at angular positions corresponding to 0° and 180° while the full hole nozzles 34 are located at angular positions corresponding to 90° and 270°. The upper ends of the nozzles 32, 34 receive enlarged sealing rims 56 as will be more fully pointed out hereinafter.

Inside the housing 36, the diverter valve 38 is mounted for indexing movement in reciprocable and rotary directions. When high pressure water is admitted to the upper end of the housing 36, the diverter valve 38 is depressed against a spring assembly 58 shown in FIGS. 2 and 5 and is thereby cammed in a rotary direction shown by the arrow 60 by the cooperation of a guide track 62 on the exterior of the valve body 64 and a plurality of roller assemblies 66.

The spring assembly 58 may be of any suitable type and includes a cylindrical housing 68 connected to and extending downwardly from the base plate 48. A helical spring 70 extends through an opening 72 in the base plate 48 and into a blind opening 73 in the bottom of the diverter valve 38. When high pressure water is admitted into the top of the drilling assembly 30, the diverter valve 38 is moved downwardly against the spring 70. When the flow of high pressure water stops, the spring 70 moves the diverter valve 38 upwardly, away from the base plate 48.

The guide track 62 is a cyclic, repeating groove in the exterior of the valve body 64 and includes a series of evenly spaced lower generally vertical slot sections 74 corresponding to the uppermost position of the diverter valve body 64, a series of evenly spaced upper generally vertical slot sections 76 corresponding to the lowermost position of the diverter valve body 64, a series of downwardly inclined slot sections 78 extending counterclockwise from the slot sections 76 to the slot sections 74 and a series of upwardly inclined slot sections 80 extending counterclockwise from the slot sections 74 to the slot sections 76. The slots 74, 76 are spaced on the periphery of the valve body 64 so each up stroke rotates the valve body 64 45° and each downstroke rotates the valve body 64 45° for a total of 90° per cycle. It will accordingly be seen that every time the high pressure water is turned on, the valve body 64 indexed 45°. When the high pressure water is turned off, the spring 70 indexes the valve body 64 another 45°. As will be more fully apparent hereinafter, this causes the flow of high pressure water to be applied alternately to the pilot nozzles 32 and then to the full hole nozzles 34.

Figure 6:
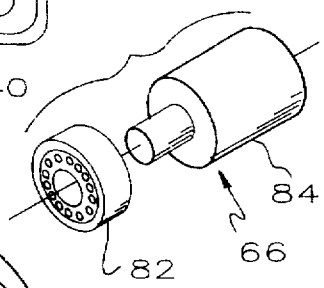
FIG. 6 is an exploded isometric view of the roller assembly that cooperates with the diverter valve element.

The roller assemblies 66 include a cam 82 preferably comprising a circular outer race of a roller bearing assembly, such as shown in FIG. 6 and a stem 84. A plurality of roller assemblies 66 are positioned on the periphery of the housing 36 with the stem 84 in the openings 46 so the cams 82 are located in the guide slot 62 at analogous locations, i.e. all of the cams 82 are positioned in the same relative position in the guide slot 62 so that the linear force applied by pressure above the diverter valve 38 or by the spring 70 below the diverter valve 38 is translated into rotary and linear motion of the diverter valve 38.

Figure 3:
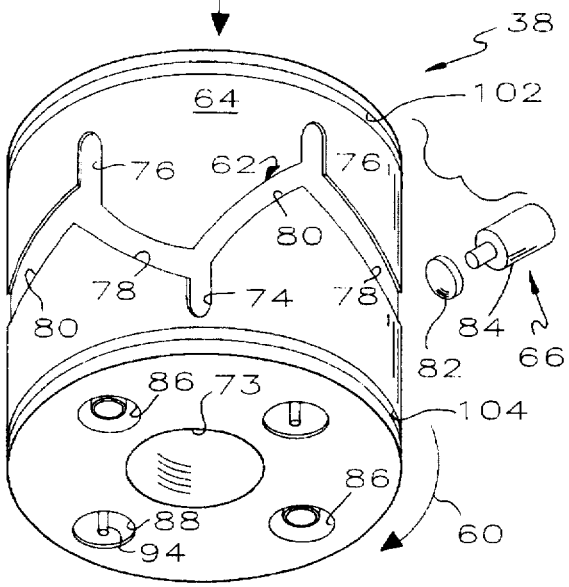
FIG. 3 is an isometric view of the diverter valve element and its cooperation with a roller assembly.
Figure 4:
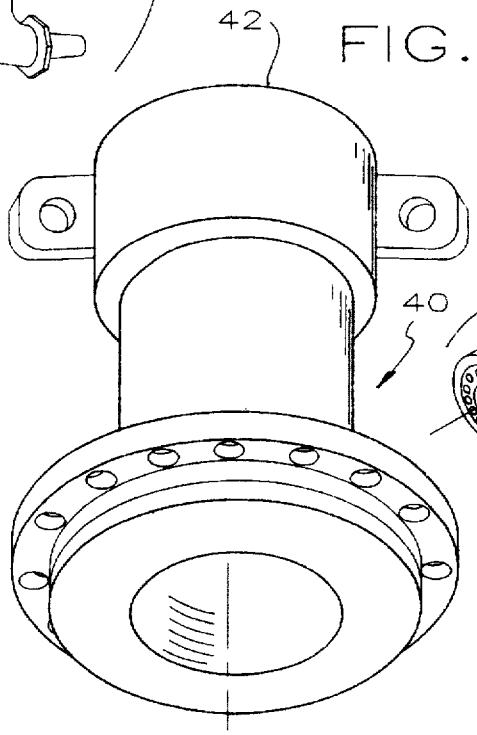
FIG. 4 is an exploded isometric view of the upper end of the diverter valve assembly.

As shown in FIG. 3, the slots 78 open into the slots 74 above the bottom of the slots 74 and the slots 80 open into the slots 76 below the top of the slots 76. When the diverter valve 38 is moving downwardly, the cams 82 engage the upper edge of the slots 80 so the position of the upper edge of the slots 80 dictates the position of the cams 82 which is desirably at a location where the cams 82 enter the slots 76. Similarly, when the diverter valve 38 is moving upwardly, the cams 82 engage the lower edge of the slots 78 so the position of the lower edge of the slots 78 dictates the position of the cams 82 which is desirably at a location where the cams 82 enter the slots 74.

The diverter valve 38 includes a series of passages 86, 88 extending axially through the valve body 64. The passages 86 are designed to transmit a high pressure, high volume stream of water to the nozzles 32, 34. To this end, the passages 86 are positioned to receive the sealing rims 56 of the nozzles 32, 34 in the lowermost position of the diverter valve 38. Inside each of the passages 86, 88 is a recessed shoulder receiving a recessed durable semi-compressible flat washer 90. The flat washers 90 may be made of any suitable sealing material, the more durable the better. When the diverter valve 38 moves to its lowermost position, the sealing rims 56 enter the passages 86, 88 and sealingly abut the washers 90 thereby directing high pressure water into the nozzles 32, 34.

Figure 7:
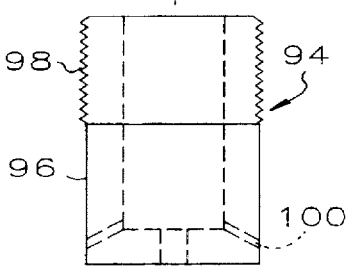
FIG. 7 is an enlarged view of a flushing nozzle used to remove coke build up from inside the diverter valve assembly.

The passages 88 are designed to deliver a small volume, moderate pressure stream of water to clean the sealing rims 56 which are effectively out of cutting service. To this end, the passages 88 receive a small conduit 92 that terminates in a small cleaning nozzle 94 shown in FIG. 7. The nozzle 94 includes a nozzle body 96 having a threaded end 98 received in the conduit 92 and a plurality of passages 100 opening laterally of the axis 101 of the nozzle 94. When the diverter valve 38 is being pumped downwardly, and is being held in the lowermost position, by pressure applied by the pumps 29, a small quantity of water is delivered by the nozzles 94 onto and into the sealing rims 56 of the nozzles 32, 34 that are out of service. Thus, debris collecting in the sealing rims 56 is washed out thereby prolonging the life of the sealing rims 56.

Operation of the drilling assembly 30 should now be apparent. When no fluid pressure is applied by the pump 29, the spring assembly 58 raises the diverter valve 38 inside the housing 36 to an uppermost position. As fluid is delivered by the pump 29 to the drilling assembly 30, the diverter valve 38 moves downwardly inside the housing 36 with O-ring type seals (not shown) operating in upper and lower grooves 102, 104 sealing between the diverter valve 38 and the housing 36. The rotational position of the diverter valve 38 is controlled by the cams 82 cooperating with the guide track 62. Assuming that the last operational position of the diverter valve 38 was in a full hole drilling operation, downward movement of the diverter valve 38 and the camming action between the roller assembly 66 and the guide track 62 positions the diverter valve 38 so the passages 86 align with and pass onto the sealing rims 56 of the pilot hole nozzles 32. Thus, the diverter valve 38 delivers high pressure water to drill a pilot hole.

When the operator stops operation of the pump 29, the spring assembly 58 raises the diverter valve 38. Upward movement of the diverter valve 38 and the camming action between the roller assemblies 66 and the guide track 62 causes the diverter valve 38 to index 45°. When the operator restarts operation of the pump 29, the diverter valve 38 moves downwardly and is indexed 45° by the camming action between the roller assemblies 66 and the guide track 62 so the passages 86 align with and pass onto the sealing rims 56 of the full hole nozzles 34. Thus, the diverter valve 38 now delivers high pressure water to drill a full hole.

The valve 38 thus has two rotational positions at the bottom of its down stroke. In the first rotational position, the vast bulk of the water pumped through the drill stem 24 exits through the pilot hole nozzles 32 while a very minor stream of water passes through the cleaning nozzles 94 to clean the sealing rims 56 of the out of service full hole nozzles 34. In the second rotational position, the bulk of the water pumped through the drill stem 24 exits through the full hole nozzles 34 and a small amount of water cleans the out of service pilot hole nozzles 32. When the diverter valve 38 is in its correct position, i.e. the operator wants to cut a pilot hole and water is being supplied to the pilot hole nozzles 32, the pilot hole is cut in the coke drum in a conventional manner.

After the pilot hole is cut, the operator shuts off the pump 29 which automatically indexes the diverter valve 38 45° on the upstroke. When the operator is ready to cut the full diameter of the coke drum, restarting the pump 29 causes the diverter valve 38 to index another 45° to align the passages 86 with the full hole nozzles 34. If, by some quirk, the diverter valve 38 is in its incorrect position, i.e. the operator wants to cut a pilot hole and water is being supplied to the full hole nozzles, the situation will be apparent to the operator who corrects the situation simply by shutting off the pump 29 and then restarting it.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. In a drilling operation including a drill stem, a drilling assembly on the end of the drill stem and including a downwardly directed pilot nozzle for drilling a vertical pilot hole and an outwardly directed full hole nozzle for enlarging the pilot hole and a pump for delivering high pressure fluid to the nozzle, the improvement comprising means responsive to stopping high pressure fluid flow to the drill stem and then restarting high pressure fluid flow to the drill stem for shifting fluid flow from the pilot nozzle to the full hole nozzle and including a housing providing a fluid inlet and a fluid outlet having a first passage to the pilot nozzle and a second passage to the full hole nozzle, a diverter valve body in the housing shiftable between a first position connecting the fluid inlet to the first passage and a second position connecting the fluid inlet to the second passage, and means mounting the diverter valve body for movement between the first and second positions in response to stopping high pressure fluid flow to the drill stem and then restarting high pressure fluid flow to the drill stem.

2. The combination of claim 1 further comprising means responsive to stopping high pressure fluid flow to the drill stem and then restarting high pressure fluid flow to the drill stem for shifting the diverter valve body from the second position to the first position in response to stopping high pressure fluid flow to the drill stem and then restarting high pressure fluid flow to the drill stem.

3. The combination of claim 1 further comprising a coker unit having a plurality of coke drums and a rig for drilling coke out of the drums, the rig comprising the drill stem and the drilling assembly.

4. The combination of claim 3 wherein the rig comprises a derrick on top of each of the coke drums, a crown block on the derrick, a travelling block and a plurality of lines suspending the travelling block from the crown block, the drill stem being suspended from the travelling block.

5. The combination of claim 1 wherein the diverter valve body has an intermediate position between the first and second positions and the mounting means comprises means for shifting the diverter valve body from the first position to the intermediate position in response to stopping high pressure fluid flow to the drill stem and means for shifting the diverter valve body from the intermediate position to the second position in response to restarting high pressure fluid flow to the drill stem.

6. The combination of claim 5 wherein the mounting means comprises means for shifting the diverter valve body from the second position to the intermediate position in response to stopping high pressure fluid flow to the drill stem and means for shifting the diverter valve body from the intermediate position to the first position in response to restarting high pressure fluid flow to the drill stem.

7. In a drilling operation including a drill stem, a drilling assembly on the end of the drill stem and including a downwardly directed pilot nozzle for drilling a vertical pilot hole and an outwardly directed full hole nozzle for enlarging the pilot hole, the improvement comprising means responsive to fluid flow in the drill stem for shifting fluid flow from the pilot nozzle to the full hole nozzle and for shifting fluid flow from the full hole nozzle to the pilot nozzle, the fluid flow responsive means comprising a diverter valve having a a housing providing an outlet end having a first passage to the pilot nozzle and a second passage to the full hole nozzle, and a main fluid inlet, a valve body in the housing having a main fluid passage extending from the outlet end toward the inlet, means mounting the diverter valve for axial movement toward the outlet end in response to fluid flow toward the drilling assembly, and means mounting the diverter valve for rotational movement between a first lowermost position connecting the main fluid passage to the pilot hole nozzle and a second lowermost position connecting the main fluid passage to the full hole nozzle.

8. The combination of claim 7 wherein the means mounting the diverter valve for rotational movement includes a guide track on the exterior of the valve body and a cam, extending through the housing, into cooperative engagement with the guide track.

9. The combination of claim 8 wherein the guide track comprises a groove in the exterior of the valve body.

10. The combination of claim 5 wherein the cam comprises a roller bearing, received in the groove, having a stationary stem extending through the housing.

11. The combination of claim 7 wherein the outlet end of the housing comprises an end plate and the pilot nozzle comprises an upstanding sealing rim on the end plate arranged to be received in the main fluid passage of the valve body and further comprising means sealing between the sealing rim and the main fluid passage.

12. The combination of claim 11 wherein the valve body includes a recessed shoulder in the main fluid passage and the sealing means comprises a flat washer abutting the recessed shoulder and arranged to abut the sealing rim of the pilot nozzle in a lowermost position of the diverter valve.

13. The combination of claim 7 wherein the outlet end of the housing comprises an end plate and the full hole nozzle comprises an upstanding sealing rim on the end plate arranged to be received in the main fluid passage of the valve body and further comprising means sealing between the sealing rim and the main fluid passage.

14. The combination of claim 13 wherein the valve body includes a recessed shoulder in the main fluid passage and the sealing means comprises a flat washer abutting the recessed shoulder and arranged to abut the sealing rim of the full hole nozzle in a lowermost position of the diverter valve.

15. The combination of claim 5 wherein the full hole nozzle comprises an upstanding sealing rim on the end plate and the valve body includes a secondary fluid passage having a cleaning nozzle therein, the cleaning nozzle being arranged to be received in the full hole nozzle when the main fluid passage receives the pilot nozzle.

* * * * *